US008843013B2

(12) United States Patent
Sawamura

(10) Patent No.: US 8,843,013 B2
(45) Date of Patent: Sep. 23, 2014

(54) FIXING DEVICE AND IMAGE FORMING APPARATUS HAVING POWER SUPPLY WIRE PROTECTION

(75) Inventor: Jun Sawamura, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 169 days.

(21) Appl. No.: 13/553,042

(22) Filed: Jul. 19, 2012

(65) Prior Publication Data

US 2013/0236221 A1 Sep. 12, 2013

(30) Foreign Application Priority Data

Mar. 12, 2012 (JP) ..... 2012-054076

(51) Int. Cl.
*G03G 15/00* (2006.01)
*G03G 21/16* (2006.01)
*G03G 15/20* (2006.01)

(52) U.S. Cl.
CPC ..... *G03G 15/2017* (2013.01); *G03G 21/1652* (2013.01); *G03G 15/2085* (2013.01); *G03G 2221/166* (2013.01)
USPC ..... 399/90; 399/122; 399/323; 399/328; 439/207

(58) Field of Classification Search
CPC ..... G03G 15/2017; G03G 21/1652; G03G 2221/166; G03G 15/2085
USPC ..... 399/90, 122, 323, 328; 439/207–208
See application file for complete search history.

(56) References Cited

U.S. PATENT DOCUMENTS 8,644,716 B2 * 2/2014 Ogawahara ..... 399/90
2009/0263155 A1 * 10/2009 Murano
2011/0048792 A1 * 3/2011 Masaka
2011/0236037 A1 * 9/2011 Ogawahara ..... 399/90

FOREIGN PATENT DOCUMENTS

JP 04-161976 A 6/1992

* cited by examiner

*Primary Examiner* — David Gray
*Assistant Examiner* — Laura Roth
(74) *Attorney, Agent, or Firm* — Sughrue Mion, PLLC

(57) ABSTRACT

A fixing device includes a heat member that includes a heat portion and rotates in a circumferential direction; a pressure member that faces the heat member and fixes a toner image transferred on a sheet to the sheet by applying pressure when the heat member applies heat; and first and second housing chambers that house electric wires, that are spaces isolated from the heat member and the pressure member, and that respectively have first and second openings being open to the outside in the circumferential direction and being covered with lid members, the electric wires being respectively arranged through the first and second openings, the second housing chamber being formed separately from the first housing chamber, the second opening being open in a direction different from a direction of the first opening.

8 Claims, 8 Drawing Sheets

FIXING DEVICE AND IMAGE FORMING APPARATUS HAVING POWER SUPPLY WIRE PROTECTION

CROSS-REFERENCE TO RELATED APPLICATIONS

This application is based on and claims priority under 35 USC 119 from Japanese Patent Application No. 2012-054076 filed Mar. 12, 2012.

BACKGROUND

The present invention relates to a fixing device and an image forming apparatus.

SUMMARY

According to an aspect of the invention, there is provided a fixing device including a heat member that includes a heat portion, the heat member rotating in a circumferential direction; a pressure member that faces the heat member, the pressure member fixing a toner image transferred on a sheet to the sheet by applying pressure when the heat member applies heat; a first housing chamber that houses an electric wire, the first housing chamber being a space isolated from the heat member and the pressure member, the first housing chamber having a first opening, the first opening being open to the outside in the circumferential direction, the first opening being covered with a lid member, the electric wire being arranged through the first opening; and a second housing chamber that houses an electric wire, the second housing chamber being a space isolated from the heat member and the pressure member, the second housing chamber being formed separately from the first housing chamber, the second housing chamber having a second opening, the second opening being open to the outside in the circumferential direction, the second opening being formed in a direction different from a direction of the first opening, the second opening being covered with a lid member, the electric wire being arranged through the second opening.

BRIEF DESCRIPTION OF THE DRAWINGS

An exemplary embodiment of the present invention will be described in detail based on the following figures, wherein.

DETAILED DESCRIPTION

An exemplary embodiment of the present invention is described below in detail with reference to the accompanying figures.

Figure 1:
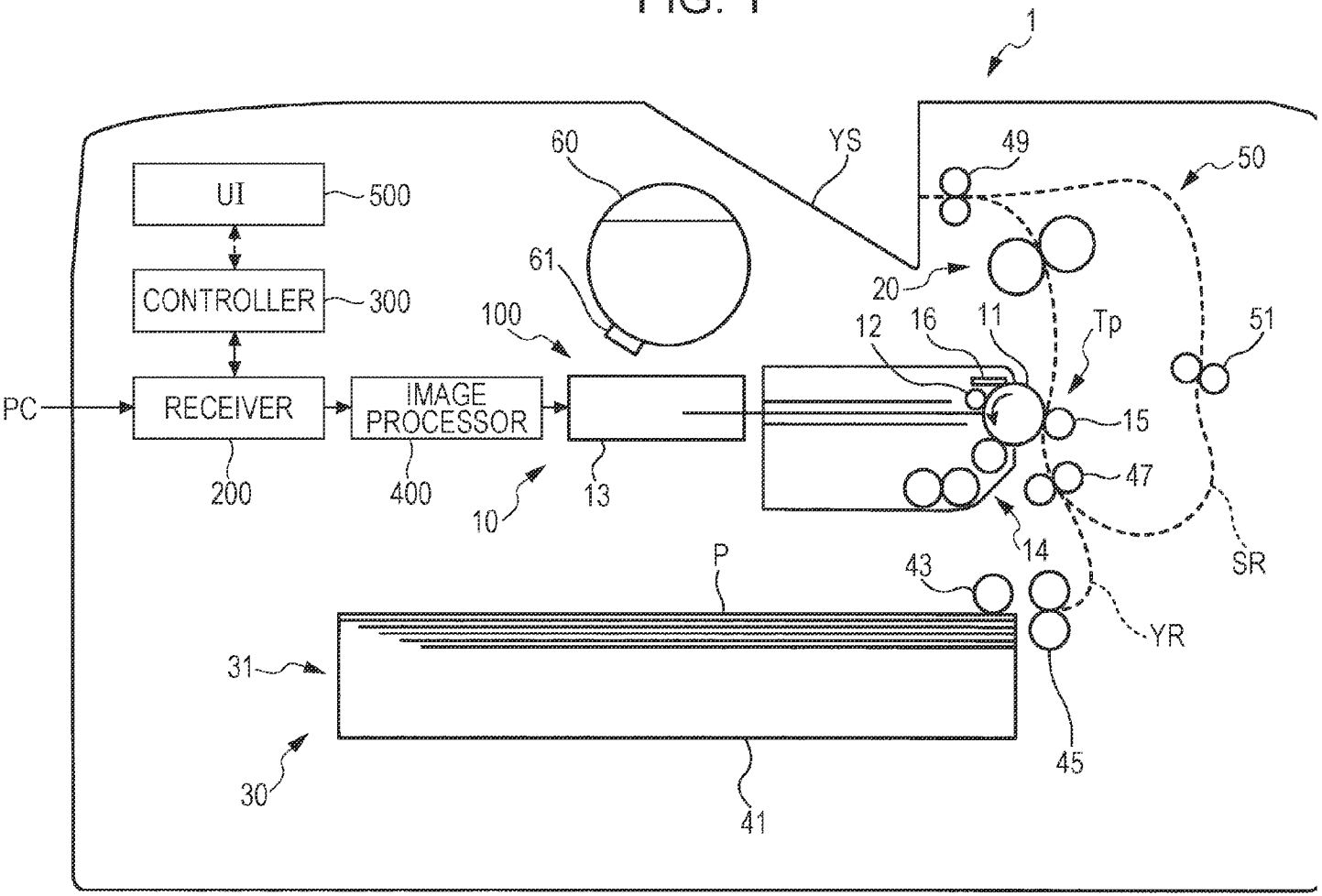
FIG. 1 is an illustration showing a brief configuration of an image forming apparatus to which an exemplary embodiment is applied.

FIG. 1 is an illustration showing a brief configuration of an image forming apparatus 1 to which an exemplary embodiment is applied. The image forming apparatus 1 includes an image forming unit 10 that forms a toner image on a sheet P being an example of a recording material. The image forming apparatus 1 also includes a fixing device 20 that fixes the toner image formed on the sheet P by the image forming unit 10 by applying heat and pressure to the toner image, and a sheet feeding section 30 that feeds the sheet P to the image forming unit 10.

The image forming apparatus 1 includes a process cartridge 100. The process cartridge 100 may be removed from a body part (an apparatus body) of the image forming apparatus 1 when the process cartridge 100 is pulled out to the front side (the left side in the figure) of the image forming apparatus 1. Also, in this exemplary embodiment, after the process cartridge 100 is removed, an additional process cartridge 100 may be mounted.

The process cartridge 100 includes a photoconductor drum 11, a charging device 12, a developing device 14, and a cleaning device 16. Also, the image forming apparatus 1 according to this exemplary embodiment includes an exposure device 13 and a transfer device 15.

The image forming unit 10 is an example of a toner-image forming unit, the transfer device 15 is an example of a transfer unit, and the fixing device 20 is an example of a fixing unit.

Also, the image forming apparatus 1 includes a toner cartridge 60 that is removably mounted on the apparatus body of the image forming apparatus 1, and houses a toner that is fed to the process cartridge 100.

The toner cartridge 60 has a memory medium 61 formed of, for example, an electrically erasable and programmable read only memory (EEPROM). The memory medium 61 stores information relating to the state of use of the toner cartridge 60, such as information indicative of the type of toner cartridge 60, and the number of rotations of a rotational member (a rotational member used for transporting a toner) provided in the toner cartridge 60.

The photoconductor drum 11 has a photosensitive layer on its outer peripheral surface and rotates in a direction indicated by arrow in the figure. The charging device 12 has a charging roller that contacts the photoconductor drum 11, and charges the photoconductor drum 11 to have a predetermined potential.

The exposure device 13 forms an electrostatic latent image on the photoconductor drum 11 by emitting laser light to the photoconductor drum 11 and selectively exposing the photoconductor drum 11 to light, the photoconductor drum 11 which is being charged by the charging device 12. The developing device 14 has a development roller, and forms a toner image on the photoconductor drum 11.

More specifically, the developing device 14 houses, for example, a developer containing two components including a toner that is charged to have a negative polarity, and a carrier that is charged to a positive polarity. Then, the developing device 14 develops the electrostatic latent image formed on the photoconductor drum 11 and hence forms a toner image on the photoconductor drum 11. The transfer device 15 has a roller-shaped member, and transfers the toner image formed on the photoconductor drum 11 onto a sheet P by forming an electric field in an area (a transfer part Tp) between the transfer device 15 and the photoconductor drum 11. Also, the cleaning device 16 has a cleaning blade that contacts the photoconductor drum 11, and removes a toner and other substances remaining on the photoconductor drum 11 by using this cleaning blade.

Referring to FIG. 1, the sheet feeding section 30 includes a sheet feeding unit 31 so that the sheet feeding unit 31 may feed a sheet P to the image forming unit 10. The sheet feeding unit 31 includes a sheet housing portion 41 that houses sheets P, a drawing roller 43, and a separating mechanism 45. The sheet housing portion 41 has an opening at the upper side and a rectangular-parallelepiped shape, and houses plural sheets P in the sheet housing portion 41. The drawing roller 43 contacts sheets P at the top of a bundle of sheets housed in the sheet housing portion 41, and sends the top sheets P to the separating mechanism 45. The separating mechanism 45 includes, for example, a rotatable feed roller and a non-rotatable retard roller, and separates the sheets P sent by the drawing roller 43 one by one.

Additionally, an additional sheet feeding unit may be provided in a lower portion of the sheet feeding unit 31 so that sheets P of other size or other type may be fed to the image forming unit 10.

Also, the sheet feeding section 30 has a registration roller 47. The registration roller 47 temporarily stops transportation of a sheet P in a state in which the registration roller 47 is not rotated. Then the registration roller 47 is rotated at a predetermined timing and hence feeds the sheet P while the registration roller 47 provides registration adjustment for the transfer part Tp.

If the additional sheet feeding unit (not shown) is provided, a transport roller (not shown) that transports a sheet P transported from the additional transport unit (not shown) to the registration roller 47 is provided.

The image forming apparatus 1 according to this exemplary embodiment has a sheet transport path YR through which a sheet P is transported. Also, the image forming apparatus 1 has a sheet stack portion YS on which a sheet P passing through the fixing device 20 is stacked.

Further, the image forming apparatus 1 has a sheet reverse mechanism 50 that reverses the front and back sides of a sheet P passing through the fixing device 20 and feeds again the sheet P to the transfer part Tp. The sheet reverse mechanism 50 has a reverse transport path SR that is connected with the sheet transport path YR at a position located downstream of the fixing device 20 and is joined to the sheet transport path YR at a position located upstream of the registration roller 47. Also, the sheet reverse mechanism 50 has a transport roller 51 that transports a sheet P in the reverse transport path SR.

The image forming apparatus 1 includes a receiver 200 that receives image data from a personal computer (PC, not shown) or the like. The image forming apparatus 1 also includes a controller 300 that controls entire operations of the image forming unit 10, the fixing device 20, and the sheet feeding section 30.

Further, the image forming apparatus 1 includes an image processor 400 that performs image processing for the image data received by the receiver 200 and then outputs the image data to the exposure device 13. In addition, the image forming apparatus 1 includes a user interface (UI) 500 that has a display panel, receives an instruction from a user, and displays a message and the like on the display panel for the user.

The controller 300 includes a central processing unit (CPU), a read only memory (ROM), a random access memory (RAM), and a hard disk drive (HDD), although all parts are not shown. The CPU executes a processing program. The ROM stores various programs, various tables, parameters, etc. The RAM is used as a work area or the like when the CPU performs the various programs.

When an image is formed on a sheet P, the receiver 200 receives image data formed by a personal computer (not shown) or the like, and the receiver 200 outputs the image data to the image processor 400. Then, the image processor 400 performs image processing for the image data. The image data after the image processing is output to the exposure device 13. The exposure device 13 acquiring the image data forms an electrostatic latent image by selectively exposing the photoconductor drum 11 to light, the photoconductor drum 11 which is being charged by the charging device 12. The developing device 14 develops the formed electrostatic latent image into a toner image with a color of, for example, black (K).

In the sheet feeding section 30, the drawing roller 43 is rotated in synchronization with a timing of image formation, and a sheet P is fed from the sheet housing portion 41. A sheet P of sheets P that are separated by the separating mechanism 45 one by one is transported to the registration roller 47, and is temporarily stopped. Then, the registration roller 47 is rotated in synchronization with a timing of rotation of the photoconductor drum 11, and the sheet P is fed to the transfer part Tp. The toner image formed by the photoconductor drum 11 is transferred on the sheet P at the transfer part Tp.

Then, the fixing device 20 performs fixing processing for the sheet P with the toner image transferred. An output roller 49 outputs the sheet P onto the sheet stack portion YS. If images are formed on a first side and a second side of a sheet P (images are formed on both sides of a sheet P), the sheet reverse mechanism 50 reverses the front and back sides of the sheet P passing through the fixing device 20 and feeds the sheet P again to the transfer part Tp. The toner image formed on the photoconductor drum 11 is transferred onto the second side of the sheet P at the transfer part Tp. The fixing device 20 performs the fixing processing for the sheet P with the toner image transferred on the second side. The sheet P is output to the sheet stack portion YS.

Next, the fixing device 20 is described.

Figure 2:
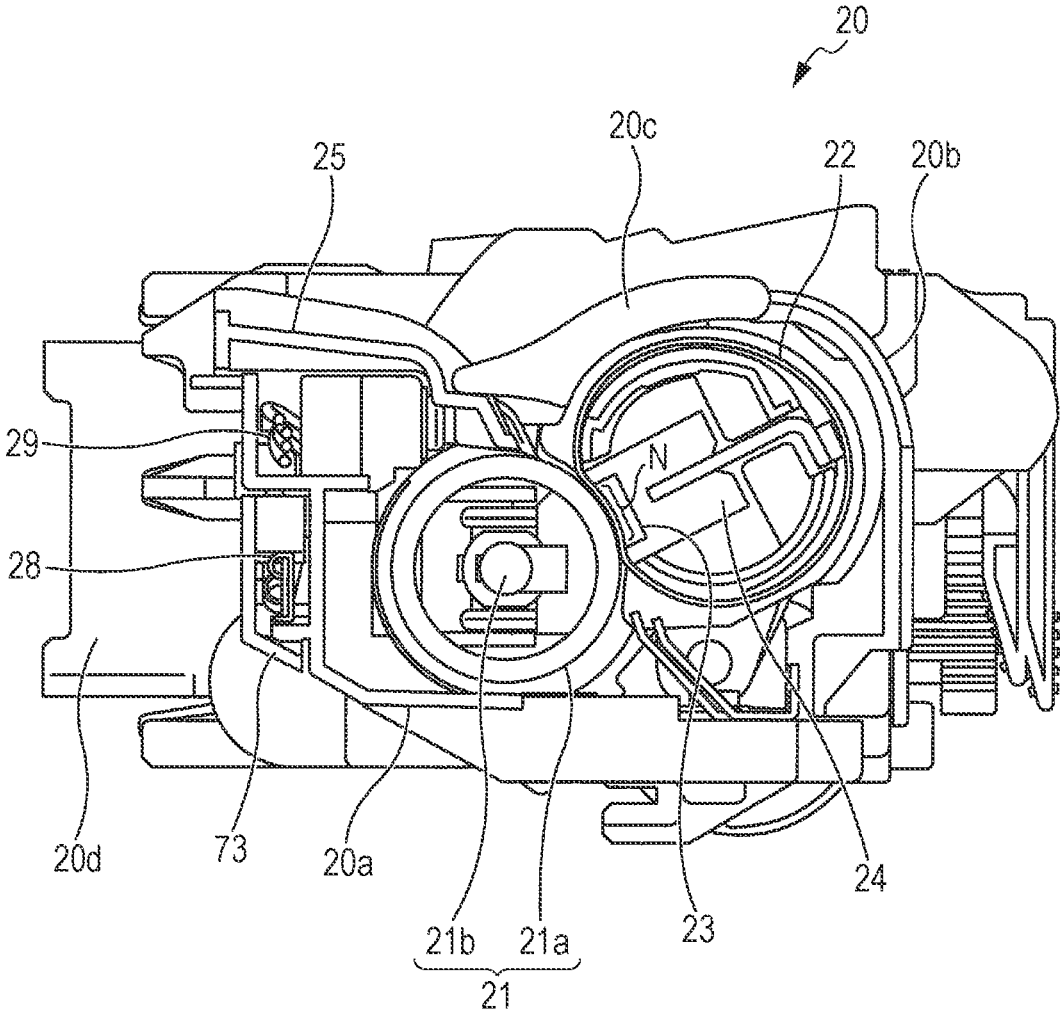
FIG. 2 is a longitudinal section showing a configuration of a fixing device according to the exemplary embodiment.

FIG. 2 is a longitudinal section showing a configuration of the fixing device 20 according to this exemplary embodiment.

As shown in FIG. 2, the fixing device 20 includes a frame 20*a*, a heat roller 21 supported by the frame 20*a* and provided rotatably in the circumferential direction, and an endless pressure belt 22 provided rotatably at the frame 20*a* and contacting the outer peripheral surface of the heat roller 21.

Also, the fixing device 20 includes a pushing pad 23 that is arranged inside the pressure belt 22 and pushes the heat roller 21 through the pressure belt 22, and a pad support member 24 that supports the pushing pad 23 and other member. In short, the fixing device 20 includes the heat roller 21, the pressure belt 22, the pushing pad 23, and the pad support member 24.

In the fixing device 20, the heat roller 21 is rotated in a direction (counterclockwise in the same figure) at a predetermined speed by a drive force of a drive motor (not shown), and the pressure belt 22 follows the rotation of the heat roller 21 and is rotationally driven in a direction (clockwise in the same figure). In particular, the pressure belt 22 is rotated in association with the heat roller 21 when the pressure belt 22 receives the rotational drive force from the heat roller 21.

In the fixing device 20, the heat roller 21 may come into contact with and be separated from the pressure belt 22, to address paper jam or other trouble.

The heat roller 21 includes a cylindrical member 21*a* made of metal and being a core member (a core), and a heater (a heat source) 21*b* provided at a center part of the cylindrical member 21*a*. The heater 21*b* may use, for example, a halogen lamp with 570 W.

To be more specific, a heat-resistant elastic layer made of, for example, silicone rubber, foam silicone rubber, fluorine rubber, or fluorine resin, is provided on the surface of the cylindrical member 21*a*. Further, a surface release layer is provided on the outermost surface of the cylindrical member 21*a*.

The pressure belt 22 has stacked layers including a base layer made of a heat-resistant sheet-shaped member, an elastic layer, and a surface release layer being the outer peripheral surface, in order from the inner peripheral surface side. The base layer uses a material being flexible, having a high mechanical strength, and being heat resistant, such as fluorine resin, polyimide resin, polyamide resin, polyamide-imide resin, PEEK resin, PES resin, PPS resin, PFA resin, PTFE resin, or FEP resin. The proper thickness is in a range from 10 to 150 μm, and more preferably in a range from 30 to 100 μm.

Also, the elastic layer uses, for example, heat-resistant and heat-conductive silicone rubber, fluorine rubber, or fluorosilicone rubber. The thickness is in a range from 10 to 500 μm, and more preferably in a range from 50 to 300 μm.

The surface release layer is made of, for example, tetra fluoro ethylene-perfluoro alkylvinyl ether copolymer (PFA), poly tetra fluoro ethylene (PTFE), fluorine resin, silicone resin, fluorosilicone rubber, fluorine rubber, or silicone rubber.

The pushing pad 23 is arranged in a range slightly larger than a region where a sheet P passes through (a sheet-pass region) in the width direction of the pressure belt 22. The pushing pad 23 pushes the heat roller 21 by the substantially entire length in the longitudinal direction of the pushing pad 23 (in a direction perpendicular to the sheet of the same figure). Also, a contact surface of the pushing pad 23 with respect to the pressure belt 22 is a concave surface extending along the shape of the outer surface of the heat roller 21. Hence, a sufficiently wide nip width may be formed with respect to the heat roller 21.

Also, a sliding sheet, which is formed of a polyimide film or a glass fiber sheet or the like impregnated with fluorine resin, and which has a good slidability and a high resistance to wear, to increase slidability between the pushing pad 23 and the pressure belt 22 at a fixing nip part N. Further, a lubricant, such as amino-modified silicone oil or dimethyl silicone oil, is applied to the inner peripheral surface of the pressure belt 22. Accordingly, a frictional resistance between the pressure belt 22 and the pushing pad 23 is decreased, and the pressure belt 22 is smoothly rotated.

The pad support member 24 is a rod-shaped member with the axis extending in the width direction of the pressure belt 22. The pushing pad 23 is mounted in a part of the pad support member 24 facing the heat roller 21. The pad support member 24 receives a pushing force which acts from the heat roller 21 to the pushing pad 23. Owing to this, the pad support member 24 uses a material with a certain rigidity such that an amount of bending is a predetermined level or smaller, and more preferably, 1 mm or smaller, when the pad support member 24 receives the pushing force from the heat roller 21.

Here, the fixing device 20 includes a peeling member 25 arranged downstream of the fixing nip part N. The peeling member 25 is close to the heat roller 21 in a direction in which the tip end of the peeling member 25 faces the heat roller 21. Hence, the peeling member 25 reliably peels off a sheet P, which is sent to the fixing nip part N, from the heat roller 21.

In the image forming apparatus 1 according to this exemplary embodiment, when an operation of forming a toner image is started, electric power is supplied to the drive motor (not shown) that drives the heat roller 21 of the fixing device 20 and a heater 21*b*, and hence the fixing device 20 is activated. Then, the heat roller 21 generates heat and is rotated, and the pressure belt 22 is rotated by the rotation of the heat roller 21.

In a state in which the heat roller 21 is heated at a predetermined temperature, a sheet P with an unfixed toner image is sent to (enters) the fixing nip part N at which the heat roller 21 contacts the pressure belt 22. At the fixing nip part N, the sheet P and the toner image formed on the sheet P are heated by the heat roller 21 and pressed by the pressure belt 22. Thus the toner image is fixed to the sheet P. Then, the sheet P is reliably peeled off from the heat roller 21 by the effect of the peeling member 25, and is transported to the sheet stack portion YS (see FIG. 1) provided at an output section of the image forming apparatus 1.

The heat roller 21 is an example of a heat member, and the heater 21*b* is an example of a heat portion. The pressure belt 22 is an example of a pressure member.

Figure 3:
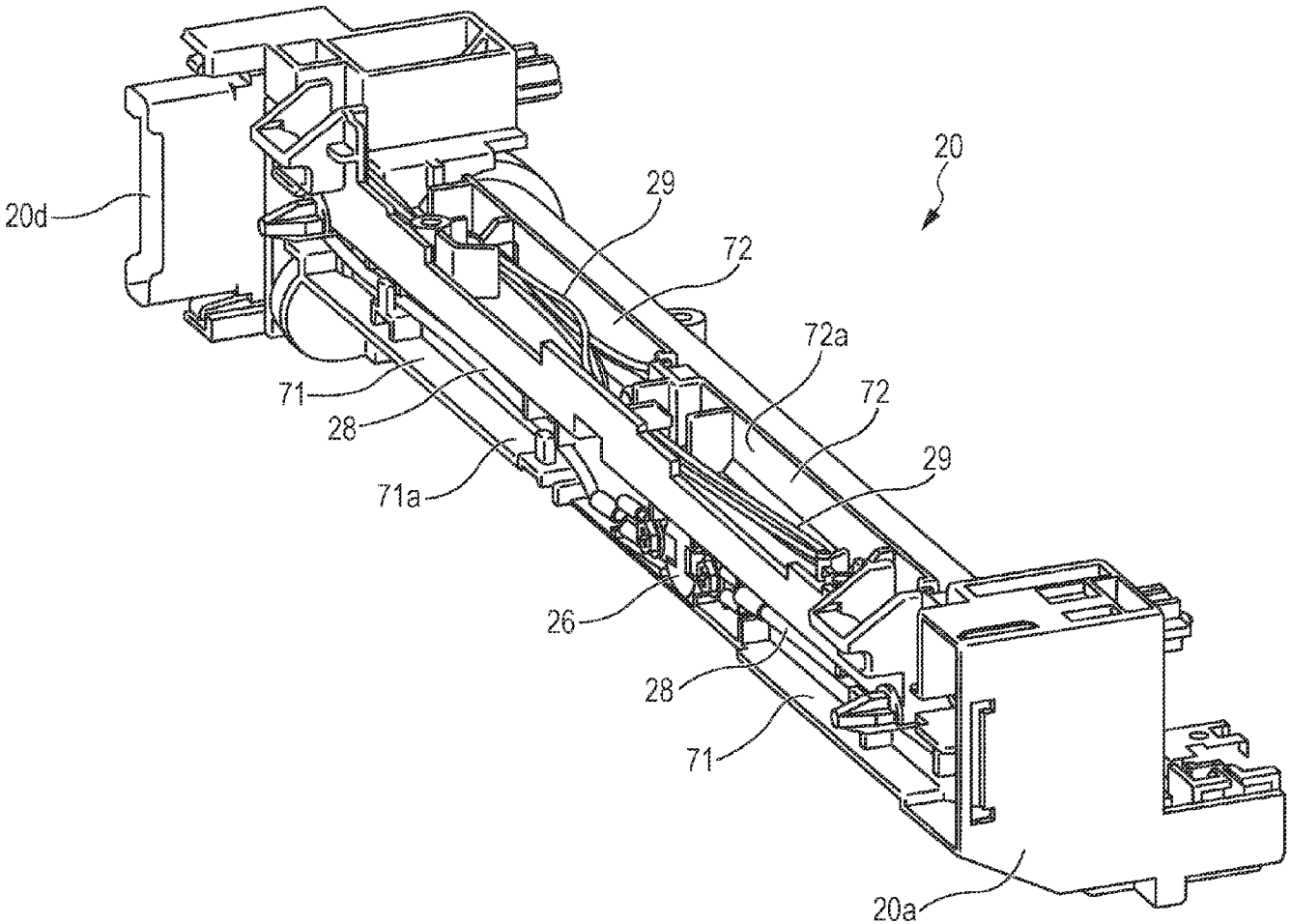
FIG. 3 is a schematic perspective view explaining the configuration of the fixing device.
Figure 4:
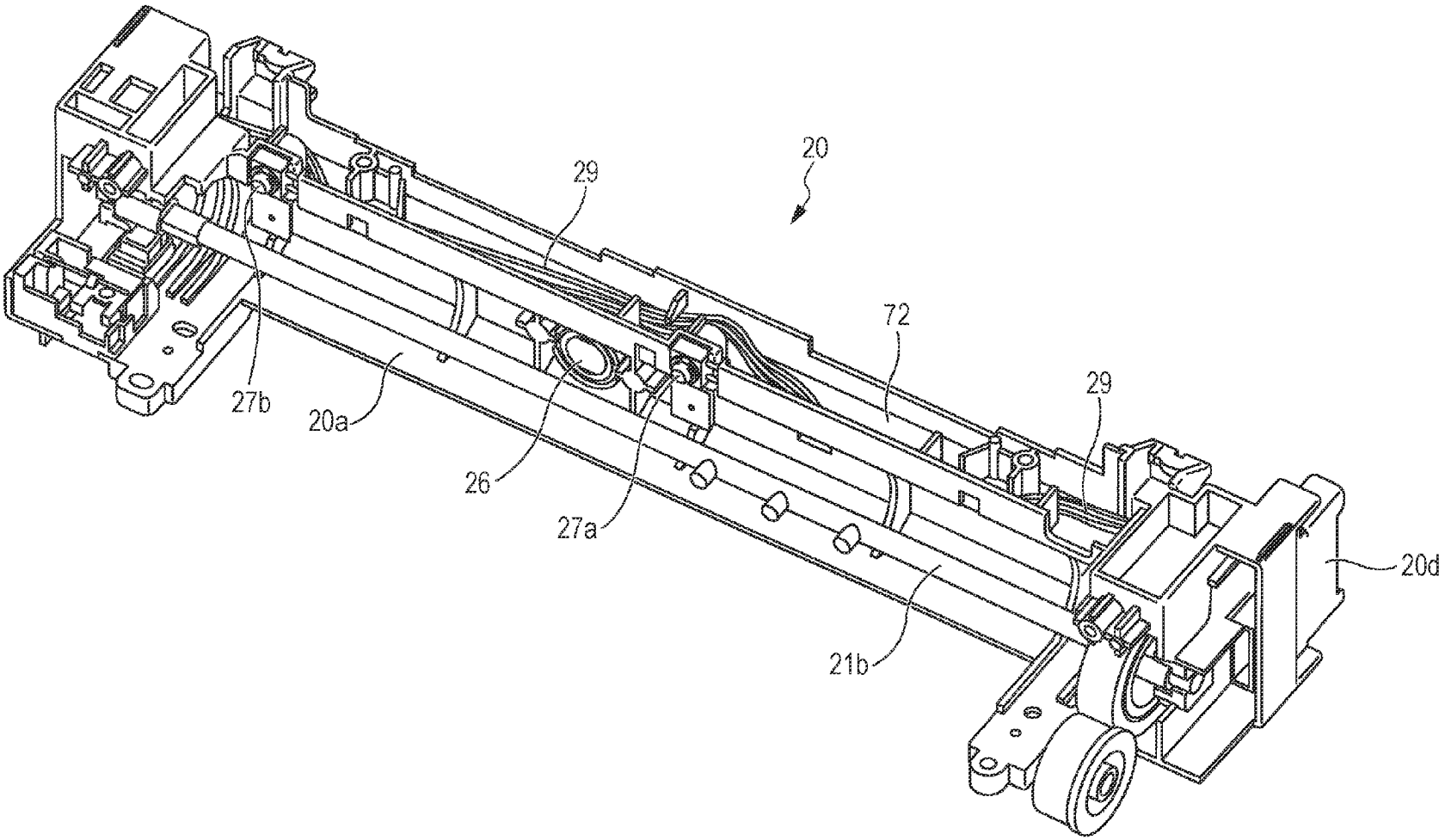
FIG. 4 is a schematic perspective view explaining the configuration of the fixing device.

FIGS. 3 and 4 are schematic perspective views explaining the configuration of the fixing device 20. FIG. 3 is a view from the side of the pressure belt 22 when the heat roller 21, the pressure belt 22, and other member are removed from the frame 20*a* of the fixing device 20. FIG. 4 is a view from a side opposite to the side in FIG. 3.

As shown in FIG. 3, the fixing device 20 includes a thermostat 26 that detects abnormal overheating of the heat roller 21, and interrupts the electric power. In particular, the thermostat 26 is arranged at an intermediate position of an AC electric wire 28 that supplies electric power to the heater 21*b* of the heat roller 21 (see FIG. 2). If abnormal overheating occurs, the thermostat 26 interrupts the electric power that is supplied to the heater 21*b*.

Also, as shown in FIG. 4, the fixing device 20 includes temperature sensors 27*a* and 27*b* that detect the temperature of the heat roller 21 heated by the heater 21*b*. The temperature sensor 27*a* is mounted at a position at which a sheet P passes through. The temperature sensor 27*b* is mounted at a position at which a sheet P does not pass through. The detection results of the temperature sensors 27*a* and 27*b* are output to the controller 300 and used for various control.

The thermostat 26 is arranged at a position that is between the temperature sensor 27*a* and the temperature sensor 27*b* in the axial direction of the heat roller 21 and that is close to the temperature sensor 27*a*.

To be more specific, alternating-current (AC) electric power is supplied to the heater 21*b* of the heat roller 21 through the thermostat 26. Also, direct-current (DC) electric power is supplied to each of the temperature sensors 27*a* and 27*b*. That is, AC-system parts, such as the heater 21*b* and the thermostat 26, and DC-system parts, such as the temperature sensors 27*a* and 27*b*, are mounted in the fixing device 20. Owing to this, the AC electric wire 28 for supply of AC electric power and a DC electric wire 29 for supply of DC electric power are arranged at the frame 20*a* of the fixing device 20.

In manufacturing processes of the image forming apparatus 1 and the fixing device 20, an assembly failure or the like may occur when the AC electric wire 28 and the DC electric wire 29 are fixed to predetermined positions. To be more specific, in related art, an AC electric wire 28 and a DC electric wire 29 may be housed together in a state in which the AC electric wires 28 and the DC electric wires 29 are partitioned by a wall, and an AC electric part and a DC electric part are assembled in a state in which the AC electric wire 28 and the DC electric wire 29 are covered with a common single cover. During assembling, if the AC electric wire 28 or the DC electric wire 29 is pinched between the cover that covers the area where the AC electric wire 28 and the DC electric wire 29 are housed, and the frame 20*a* to which the cover is mounted, and if the product is used for a long period in this state, a coating of the AC electric wire 28 and a coating of the DC electric wire 29 may be broken. Then, if the parts with the broken coatings come into contact with each other, a short (a short circuit) may occur, and the short may result in a breakdown or the like. In order to prevent such a situation, in related art, for example, a ground fault interrupter is provided.

Also, if the AC electric part and the DC electric part are covered with the common single cover, and if the AC electric wire 28 or the DC electric wire 29 is pinched between the wall partitioning the inside of the cover and the cover, the pinched state is not visually recognized from the outside of the cover.

However, if a short is prevented by a configuration other than the arrangement of the ground fault interrupter, safety is improved, and further, the cost is reduced and the apparatus is downsized. For example, a tube may be applied so as to prevent the coatings of the AC electric wire 28 and the DC electric wire 29 are not broken. However, it is difficult to ensure the prevention of a short.

In this exemplary embodiment, the frame 20*a* of the fixing device 20 is formed to provide separate spaces including a space (an AC-dedicated chamber 71, described later) that houses the AC electric wire 28 and a space (a DC-dedicated chamber 72, described later) that houses the DC electric wire 29, and hence ensures the prevention of a short. The detail is described below.

Figure 5:
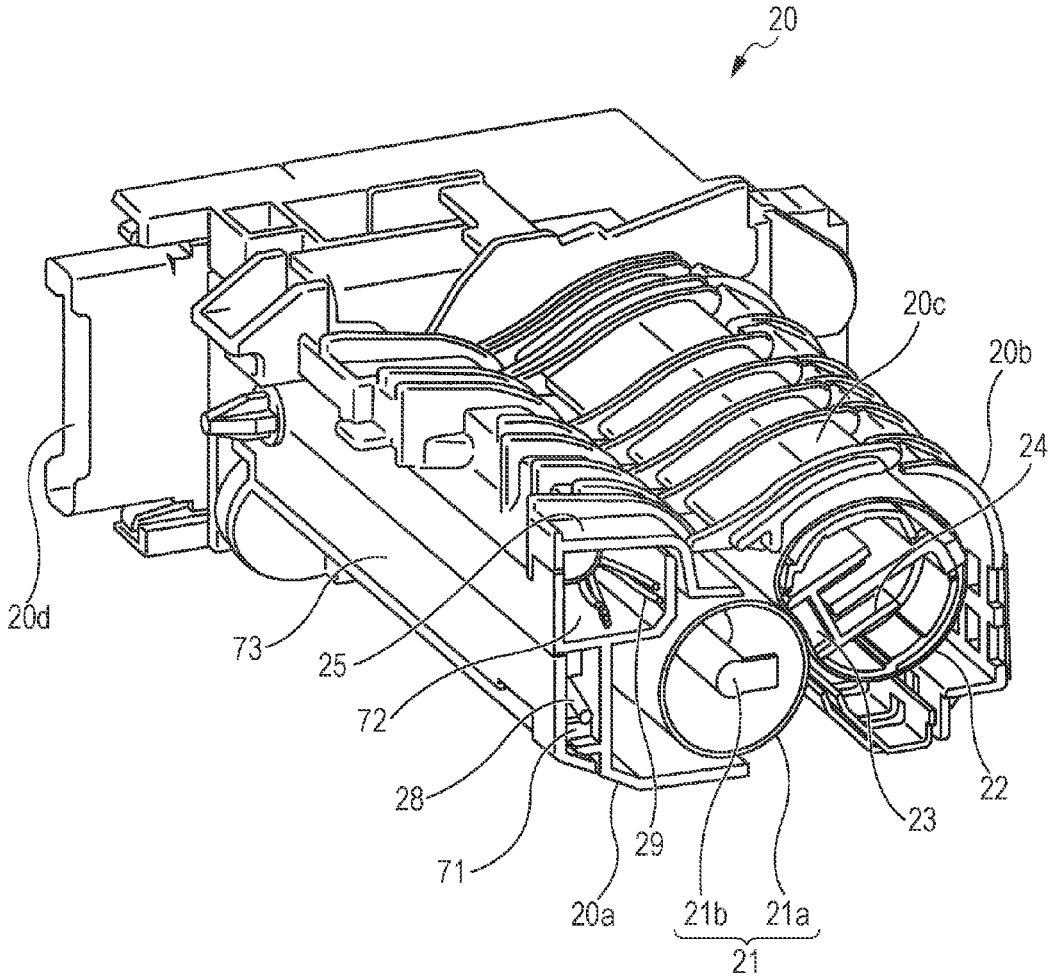
FIG. 5 is a schematic perspective view showing the fixing device when part of the fixing device is cut away and illustrated in a sectional view.
Figure 6:
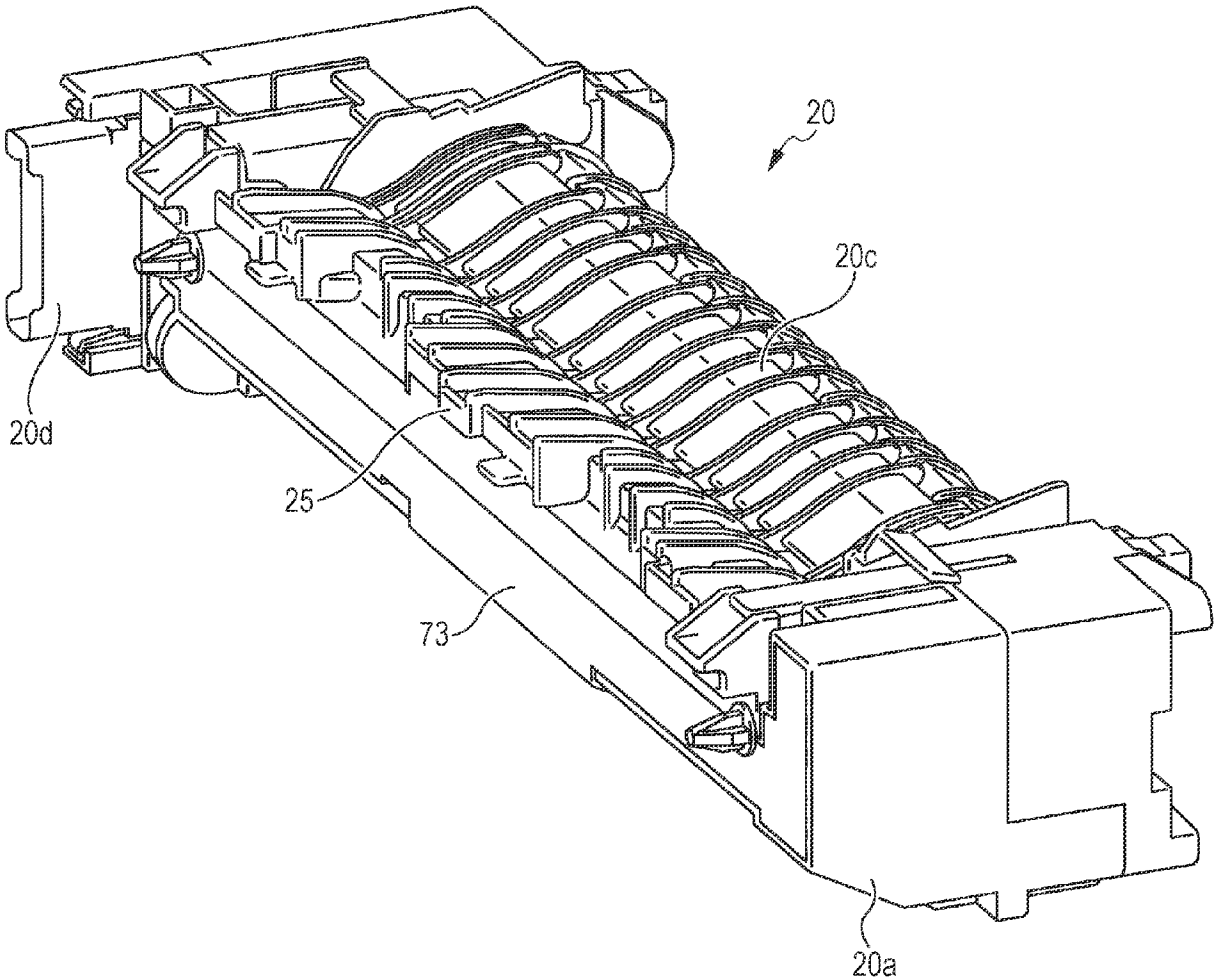
FIG. 6 is a perspective view showing the entire appearance of the fixing device.

FIG. 5 is a schematic perspective view showing the fixing device 20 when part of the fixing device 20 is cut away and illustrated in a sectional view. FIG. 6 is a perspective view showing the entire appearance of the fixing device 20.

As shown in FIG. 5, the fixing device 20 has the AC-dedicated chamber 71 in which the AC electric wire 28 is arranged, and the DC-dedicated chamber 72 in which the DC electric wire 29 is arranged. To be more specific, the AC-dedicated chamber 71 and the DC-dedicated chamber 72 are formed at the frame 20*a* separately from a space 20*e* (see FIG. 7) that houses the heat roller 21 and the pressure belt 22. That is, the AD-dedicated chamber 71 and the DC-dedicated chamber 72 are formed at the frame 20*a* so that the AD-dedicated chamber 71 and the DC-dedicated chamber 72 are partitioned from each other by the space 20*e* and walls. In other words, the AC-dedicated chamber 71 and the DC-dedicated chamber 72 are isolated from the space 20*e* (see FIG. 7).

The thermostat 26 (see FIG. 4) is mounted at a wall that forms the AC-dedicated chamber 71. The temperature sensors 27*a* and 27*b* (see FIG. 4) are mounted at a wall that forms the DC-dedicated chamber 72.

To be further specific, at the frame 20*a*, the region where the AC electric wire 28 is arranged and the region where the DC electric wire 29 is arranged are separated from each other. That is, the AC-dedicated chamber 71 and the DC-dedicated chamber 72 are partitioned from each other by the walls of the frame 20*a*. Thus, the AC-dedicated chamber 71 and the DC-dedicated chamber 72 are formed at the frame 20*a*. The AC-dedicated chamber 71 and the DC-dedicated chamber 72 are arranged next to each other.

The AC electric wire 28 is fixed to the AC-dedicated chamber 71, and the DC electric wire 29 is fixed to the DC-dedicated chamber 72 (see FIG. 3).

The fixing device 20 includes an outer cover member 20*b* that surrounds the pressure belt 22. The outer cover member 20*b* is a member different from the frame 20*a*.

Referring back to FIG. 3, the description is continued. As shown in FIG. 3, the AC-dedicated chamber 71 and the DC-dedicated chamber 72 are open to the outside. When the fixing device 20 is assembled, electric wires are housed through openings 71*a* and 72*a* being open to the outside. In particular, the AC electric wire 28 is arranged from the opening 71*a* of the AC-dedicated chamber 71, and the DC electric wire 29 is arranged from the opening 72*a* of the DC-dedicated chamber 72.

The configuration of the frame 20*a* is more specifically described with reference to FIG. 5.

As shown in FIG. 5, the AC-dedicated chamber 71 is open to a lateral side of the fixing device 20, and the DC-dedicated chamber 72 is open to the upper side of the fixing device 20. That is, the opening direction of the AC-dedicated chamber 71 differs from the opening direction of the DC-dedicated chamber 72. In other words, the AC-dedicated chamber 71 and the DC-dedicated chamber 72 are formed at mutually different surfaces.

As described above, the opening directions of the AC-dedicated chamber 71 and the DC-dedicated chamber 72 differ from each other. In other words, the opening position of the AC-dedicated chamber 71 and the opening position of the DC-dedicated chamber 72 are separated from each other. Owing to this, even if an assembly failure occurs, the AC electric wire 28 does not come into contact with the DC electric wire 29. Thus, a short may be prevented.

As shown in FIG. 6, the opening 71*a* (see FIG. 3) of the AC-dedicated chamber 71 is covered with a cover member 73 that is a plate-shaped member. Also, the opening 72*a* (see FIG. 3) of the DC-dedicated chamber 72 is covered with the peeling member 25 that is a member different from the cover member 73. The peeling member 25 is a plate-shaped member.

In this way, the AC electric wire 28 is enclosed in the AC-dedicated chamber 71 by the cover member 73, and the DC electric wire 29 is enclosed in the DC-dedicated chamber 72 by the peeling member 25.

Similarly to the peeling member 25, the cover member 73 may have other function in addition to the function of covering the opening 72*a* (see FIG. 3) of the DC-dedicated chamber 72.

The cover member 73 of the AC-dedicated chamber 71 and the peeling member 25 of the DC-dedicated chamber 72 form part of outer surfaces of the fixing device 20.

The fixing device 20 forms part of the reverse transport path SR (see FIG. 1), and includes a guide member 20*c* that guides the lower side of a sheet P transported through the reverse transport path SR.

As described above, the opening 71*a* of the AC-dedicated chamber 71 and the opening 72*a* of the DC-dedicated chamber 72 are not covered with the same member. In other words, the member that covers the opening 71*a* of the AC-dedicated chamber 71 and the member that covers the opening 72*a* of the DC-dedicated chamber 72 differ from each other. Both members may be integrally formed. However, if both members are different members, even if the AC electric wire 28 or the DC electric wire 29 is pinched, the pinched state is easily viewed from the outside.

Hence, when the opening 71*a* of the AC-dedicated chamber 71 is covered with the cover member 73, the AC electric wire 28 is visually checked whether or not the AC electric wire 28 is pinched by the cover member 73. Also, when the opening 72*a* of the DC-dedicated chamber 72 is covered with the peeling member 25, the DC electric wire 29 is visually checked whether or not the DC electric wire 29 is pinched by the peeling member 25.

To be further specific, the peeling member 25 that is a component used in related art also functions as the member that covers the opening 72*a* of the DC-dedicated chamber 72. Accordingly, the number of parts that form the fixing device 20 is decreased.

In other words, in this exemplary embodiment, a new part does not have to be added, as compared with a structure of related art in which the AC electric wire 28 and the DC electric wire 29 are housed in a single housing space.

The AC-dedicated chamber 71 is an example of a first housing chamber, the cover member 73 is an example of a lid member, the opening 71*a* is an example of a first opening, and the AC electric wire 28 is an example of an electric wire. Also, the DC-dedicated chamber 72 is an example of a second housing chamber, the peeling member 25 is an example of a lid member, the opening 72*a* is an example of a second opening, and the DC electric wire 29 is an example of an electric wire.

Figure 7:
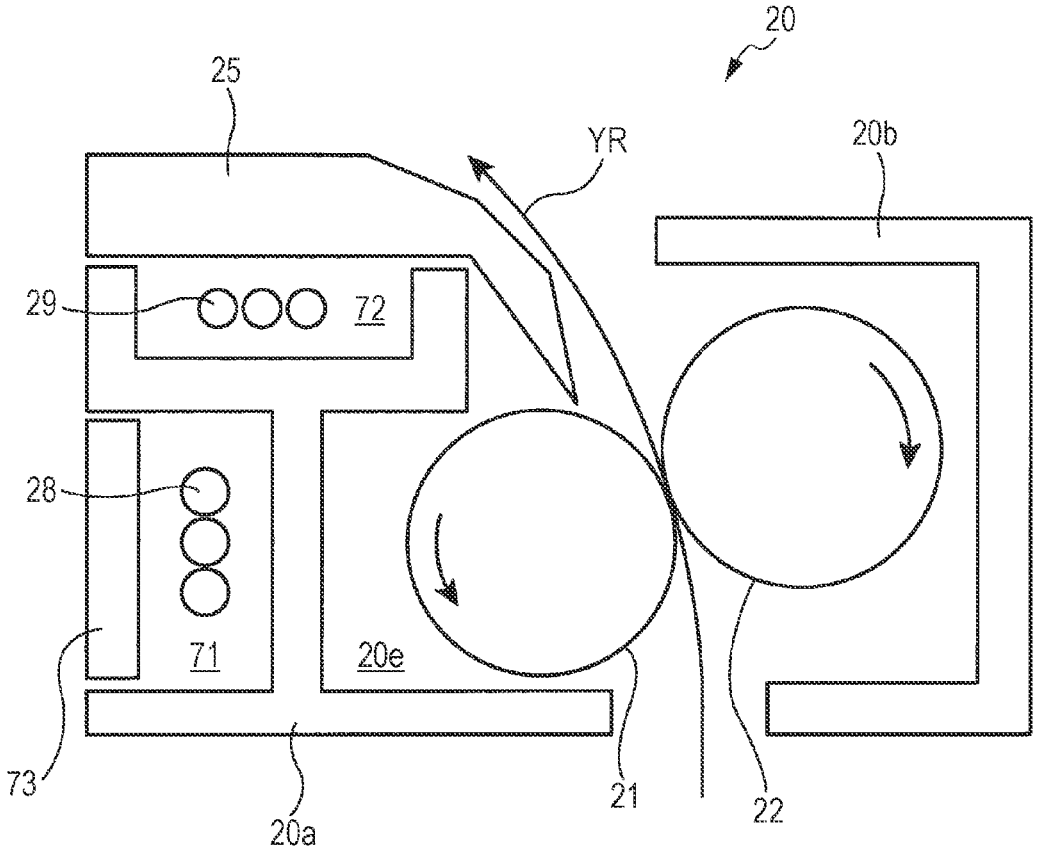
FIG. 7 is a schematic longitudinal section explaining the positional relationship among configurations of the fixing device.

FIG. 7 is a schematic longitudinal section explaining the positional relationship among configurations of the fixing device 20.

In the fixing device 20 shown in FIG. 7, the AC-dedicated chamber 71 and the DC-dedicated chamber 72 are formed at the frame 20*a* so as to be located at positions opposite to the pressure belt 22 with respect to the heat roller 21. As described above, the cover member 73 of the AC-dedicated chamber 71 and the peeling member 25 of the DC-dedicated chamber 72 define part of the outer surfaces of the fixing device 20. Owing to this, an air layer by the AC-dedicated chamber 71 and the DC-dedicated chamber 72 is formed between the outer surfaces of the fixing device 20 and the heat roller 21. The amount of heat of the heat roller 21 radiated to the outside of the fixing device 20 is reduced.

To be further specific, the AC-dedicated chamber 71 and the DC-dedicated chamber 72 are arranged next to each other and are formed at the different outer surfaces of the fixing device 20. Accordingly, the area of the air layer surrounding the heat roller 21 is further widely provided.

As described above, since the air layer is provided at the position with heat by the heater 21*b* (see FIG. 2) (an area surrounding the heater 21*b*), the heat is not radiated to the outside of the fixing device 20, and the power consumption of the heater 21*b* is restricted. Also, the cover member 73 of the AC-dedicated chamber 71 does not have to have a high heat resistance, and hence may be formed of an inexpensive material with a low heat resistance.

In this exemplary embodiment, the positional relationship between the AC-dedicated chamber 71 and the DC-dedicated chamber 72 in the fixing device 20, and the positional relationship between the opening 71*a* of the AC-dedicated chamber 71 and the opening 72*a* of the DC-dedicated chamber 72 are mere examples, and other configuration examples may be conceived.

For example, for the positional relationship between the AD-dedicated chamber 71 and the DC-dedicated chamber 72, the AC-dedicated chamber 71 and the DC-dedicated chamber 72 may be arranged at opposite positions with the heat roller 21 interposed therebetween. If the chambers are arranged next to each other like this exemplary embodiment shown in FIG. 7, the arrangement of the AC electric wire 28 and the DC electric wire 29 is easily performed. However, if the AD-dedicated chamber 71 and the DC-dedicated chamber 72 are arranged at the opposite positions, although the effect of the above-described air layer may be reduced, the separation distance between the AC-dedicated chamber 71 and the DC-dedicated chamber 72 is increased, and hence a short is prevented.

Also, for the positional relationship between the opening 71*a* and the opening 72*a*, openings may be made in mutually different directions, or openings may be made in the same direction. If the openings are made in mutually different directions, workability of assembly is sacrificed; however, a short is further reliably prevented. In contrast, if the openings are made in the same direction, the workability of assembly is increased, and a short is further reliably prevented.

Figure 8:
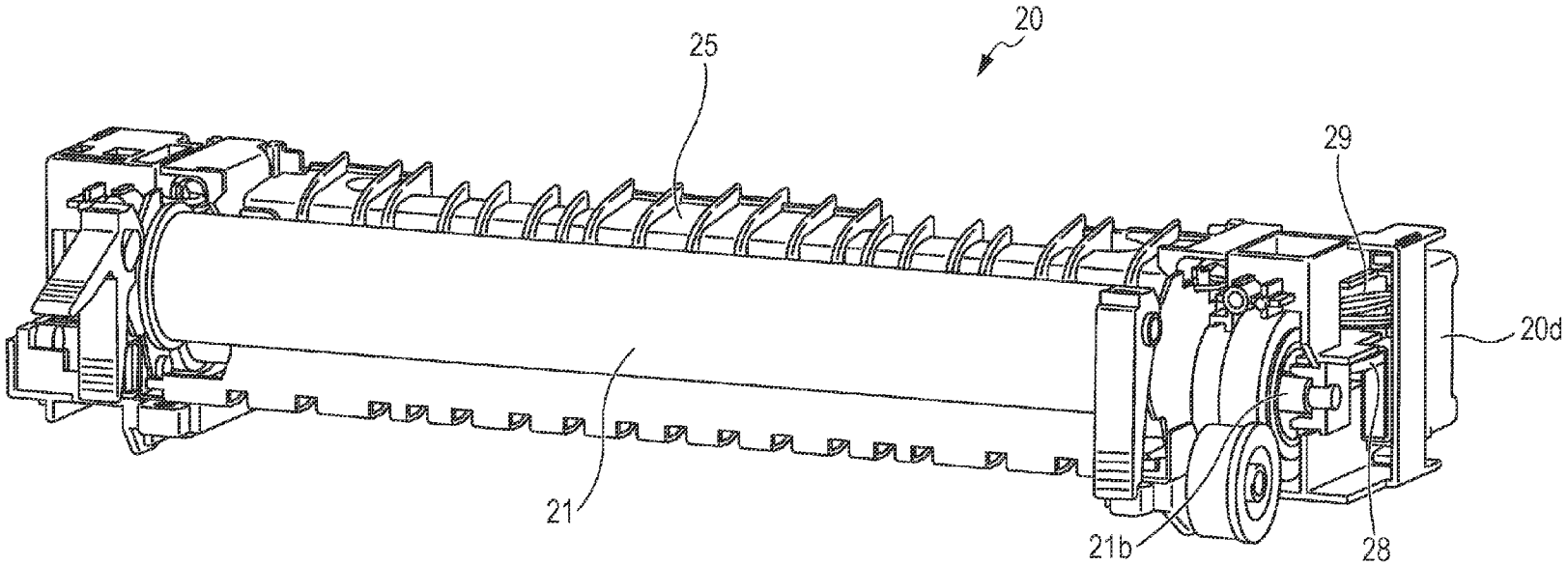
FIG. 8 is a perspective view explaining a wiring system from a connector of the fixing device.

FIG. 8 is a perspective view explaining a wiring system from a connector (not shown) of the fixing device 20.

As shown in FIG. 8, a drawer connector 20*d* is arranged at one end portion of the fixing device 20 in the axial direction of the heat roller 21. The drawer connector 20*d* is connected with a connector (not shown) provided in the image forming apparatus 1 when the fixing device 20 is mounted on the image forming apparatus 1, and the drawer connector 20*d* supplies AC electric power and DC electric power to the fixing device 20.

To be more specific, the AC electric wire 28 housed in the AC-dedicated chamber 71 and the DC electric wire 29 housed in the DC-dedicated chamber 72 are connected with the drawer connector 20*d*.

To be further specific, the AC electric wire 28 is connected with the drawer connector 20*d* at a position close to the AC-dedicated chamber 71, i.e., at a lower side in the same figure. Also, the DC electric wire 29 is connected with the drawer connector 20*d* at a position close to the DC-dedicated chamber 72, i.e., at the upper side in the same figure.

Owing to this, wiring (routing of electric wires) is provided while the AC electric wire 28 extending from the drawer connector 20*d* to the AC-dedicated chamber 71 does not intersect with the DC electric wire 29 extending from the drawer connector 20*d* to the DC-dedicated chamber 72.

In this exemplary embodiment, the DC-dedicated chamber 72 is formed in a lower portion of the frame 20*a* with respect to the AC-dedicated chamber 71. However, inverted arrangement may be conceived. In particular, the AC-dedicated chamber 71 may be formed in the lower portion of the frame 20*a* with respect to the DC-dedicated chamber 72. In this case, the DC-dedicated chamber 72 may be covered with the peeling member 25.

As described above, in this exemplary embodiment, the AC system and the DC system are housed in the different chambers in the fixing device 20. Accordingly, even if an assembly failure occurs at the AC electric wire 28 or the DC electric wire 29, a breakdown caused by a short or the like is prevented.

In this exemplary embodiment, provided is the example case in which the AC system and the DC system are housed in the different chambers. However, the present invention may be applied to various electric wires and electric circuits of, for example, a high-voltage system and a low-voltage system.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a heat member that includes a heat portion, the heat member rotating in a circumferential direction;

a pressure member that faces the heat member, the pressure member fixing a toner image transferred on a sheet to the sheet by applying pressure when the heat member applies heat;

a first housing chamber that houses a first electric wire, the first housing chamber being a space isolated from the heat member and the pressure member, the first housing chamber having a first opening, the first opening being open to the outside in the circumferential direction, the first opening being covered with a first lid member, the first electric wire being arranged through the first opening; and a second housing chamber that houses a second electric wire, the second housing chamber being a space isolated from the heat member and the pressure member, the second housing chamber being formed separately from the first housing chamber, the second housing chamber having a second opening, the second opening being open to the outside in the circumferential direction, the second opening being formed in a direction different from a direction of the first opening, the second opening being covered with a second lid member, the second electric wire being arranged through the second opening.

2. The fixing device according to claim 1, wherein the first lid member covering the first opening and the second lid member covering the second opening are different members.

3. The fixing device according to claim 1, the fixing device further comprising:

a frame that supports the heat member, wherein the first housing chamber and the second housing chamber are formed at the frame.

4. The fixing device according to claim 1, wherein at least one of the first lid member covering the first opening and the second lid member covering the second opening is a peeling member that peels off the sheet from the heat member.

5. An image forming apparatus, comprising:

a toner-image forming unit that forms a toner image;

a transfer unit that transfers the toner image formed by the toner-image forming unit, on a recording material; and a fixing unit that fixes the toner image transferred on the recording material, to the recording material, wherein the fixing unit includes:

a heat member that includes a heat portion, the heat member rotating in a circumferential direction, a pressure member that faces the heat member, the pressure member fixing the toner image transferred on the recording material to the recording material by applying pressure when the heat member applies heat, a first housing chamber that houses a first electric wire, the first housing chamber being a space isolated from the heat member and the pressure member, the first housing chamber having a first opening, the first opening being open to the outside in the circumferential direction, the first opening being covered with a first lid member, the first electric wire being arranged through the first opening, and a second housing chamber that houses a second electric wire, the second housing chamber being a space isolated from the heat member and the pressure member, the second housing chamber being formed separately from the first housing chamber, the second housing chamber having a second opening, the second opening being open to the outside in the circumferential direction, the second opening being formed in a direction different from a direction of the first opening, the second opening being covered with a second lid member, the second electric wire being arranged through the second opening.

6. The image forming apparatus according to claim 5, wherein the first lid member covering the first opening and the second lid member covering the second opening are different members.

7. The image forming apparatus according to claim 5, the fixing unit further comprising:

a frame that supports the heat member, wherein the first housing chamber and the second housing chamber are formed at the frame.

8. The image forming apparatus according to claim 5, wherein at least one of the first lid member covering the first opening and the second lid member covering the second opening is a peeling member that peels off the sheet from the heat member.

* * * * *